US010945580B2

(12) United States Patent
Curtis et al.

(10) Patent No.: US 10,945,580 B2
(45) Date of Patent: Mar. 16, 2021

(54) SPRAY NOZZLE FOR A DISHWASHER APPLIANCE

(71) Applicant: Haier US Appliance Solutions, Inc., Wilmington, DE (US)

(72) Inventors: Craig Curtis, Crestwood, KY (US); Kyle Edward Durham, Louisville, KY (US); Christopher Brandon Ross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 274 days.

(21) Appl. No.: 15/923,027

(22) Filed: Mar. 16, 2018

(65) Prior Publication Data

US 2019/0282059 A1 Sep. 19, 2019

(51) Int. Cl.

| | |
|---|---|
| ***A47L 15/16*** | (2006.01) |
| ***A47L 15/42*** | (2006.01) |
| *A47L 15/23* | (2006.01) |

(52) U.S. Cl.

CPC ..... *A47L 15/16* (2013.01); *A47L 15/4278* (2013.01); *A47L 15/23* (2013.01); *A47L 15/4282* (2013.01)

(58) Field of Classification Search

CPC ..... A47L 15/16; A47L 15/23; A47L 15/4282; A47L 15/4278

See application file for complete search history.

(56) References Cited

U.S. PATENT DOCUMENTS

| | | | | |
|---|---|---|---|---|
| 5,964,232 | A | 10/1999 | Chung | |
| 8,939,162 | B2 | 1/2015 | Winkler et al. | |
| 9,420,938 | B2 | 8/2016 | Forst et al. | |
| 2004/0112412 | A1* | 6/2004 | Han | A47L 15/4221 134/58 D |
| 2012/0279530 | A1 | 11/2012 | Thiyagarajan | |
| 2016/0367106 | A1* | 12/2016 | Thiyagarajan | G05B 15/02 |
| 2017/0071443 | A1* | 3/2017 | Boyer | F16K 11/074 |
| 2017/0071444 | A1* | 3/2017 | Hofmann | A47L 15/4221 |
| 2018/0084967 | A1* | 3/2018 | Ross | A47L 15/507 |

FOREIGN PATENT DOCUMENTS

| | | |
|---|---|---|
| EP | 0469184 A1 | 2/1992 |
| EP | 2891446 B1 | 5/2017 |
| KR | 143429 B1 | 7/1998 |

OTHER PUBLICATIONS

Machine Translation of EP 2891446 to Gunther et al., May 2017. (Year: 2017).*

* cited by examiner

*Primary Examiner* — Benjamin L Osterhout

(74) *Attorney, Agent, or Firm* — Dority & Manning, P.A.

(57) ABSTRACT

A dishwasher appliance includes a spray nozzle having a housing defining a spray chamber in fluid communication with a fluid circulation assembly. A diversion element is positioned within the spray chamber and is movable between a lowered position and a raised position where it contacts a discharge orifice. The diversion element defines a plurality of flow paths that are randomly oriented relative to the discharge orifice every time the diversion element is moved into the raised position, such as when the fluid circulation assembly cycles off and then on again.

20 Claims, 6 Drawing Sheets

SPRAY NOZZLE FOR A DISHWASHER APPLIANCE

FIELD OF THE INVENTION

The present disclosure relates generally to dishwasher appliances, and more particularly to improved spray assemblies and nozzles for dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles.

To improve spray coverage, multiple spray arm assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. One limitation of many currently known spray arm assemblies is the geometry of the spray arm assemblies and their fixed nozzle positions and orientations. For example, rotating spray arms typically have multiple nozzles positioned along a length of the spray arm. As the spray arm rotates, each nozzle emits wash fluid from a fixed location and direction relative to the arm, generating a predictable and limited circular spray pattern having gaps in spray coverage. These limitations can result in articles not being properly cleaned during operation of the dishwasher appliance.

Spray coverage gaps can be decreased by using more nozzles or by shaping the nozzles as slots to generate a broader spray from each nozzle. However, such nozzle adjustments will result in decreased impingement force unless the hydraulic power is increased. Increasing the hydraulic power results in noisier operation and increased energy consumption. Moreover, increasing the number of nozzles or the spray coverage area of the nozzles increases overall energy and water consumption.

Accordingly, a dishwasher appliance that including improved spray assemblies would be useful. More specifically, improved spray assembly and nozzle designs which increase the coverage of the wash fluid while reducing the noise and energy consumption of a dishwasher appliance would be particularly beneficial.

BRIEF DESCRIPTION OF THE INVENTION

Aspects and advantages of the invention will be set forth in part in the following description, may be apparent from the description, or may be learned through practice of the invention.

In accordance with one exemplary embodiment of the present disclosure, a dishwasher appliance defining a vertical, a lateral, and a transverse direction is provided. The dishwasher appliance includes a wash tub that defines a wash chamber and a wash rack mounted within the wash chamber, the wash rack being configured for receiving articles for washing. A fluid circulation assembly provides a flow of wash fluid for cleaning articles placed within the wash chamber. A spray nozzle includes a housing defining a spray chamber in fluid communication with the fluid circulation assembly, the housing defining a discharge orifice. A diversion element is positioned within the spray chamber, the diversion element defining a plurality of flow paths and being movable between a lowered position and a raised position, at least one of the plurality of flow paths directing the flow of wash fluid through the discharge orifice when the diversion element is in the raised position.

In accordance with another exemplary embodiment of the present disclosure, a spray nozzle for a dishwasher appliance is provided. The dishwasher appliance includes a fluid circulation assembly for selectively urging a flow of wash fluid. The spray nozzle includes a housing defining a spray chamber in fluid communication with the fluid circulation assembly, the housing defining a discharge orifice. A diversion element is positioned within the spray chamber, the diversion element defining a plurality of flow paths and being movable between a lowered position and a raised position, at least one of the plurality of flow paths directing the flow of wash fluid through the discharge orifice when the diversion element is in the raised position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
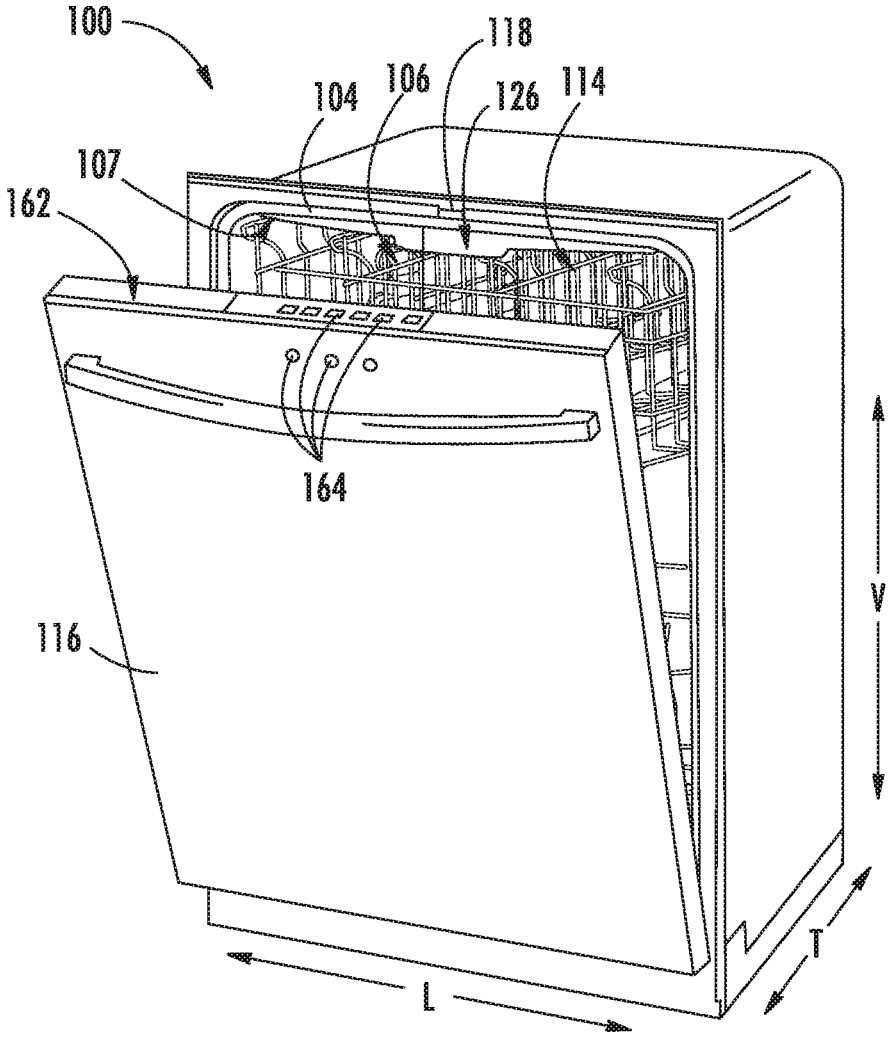
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
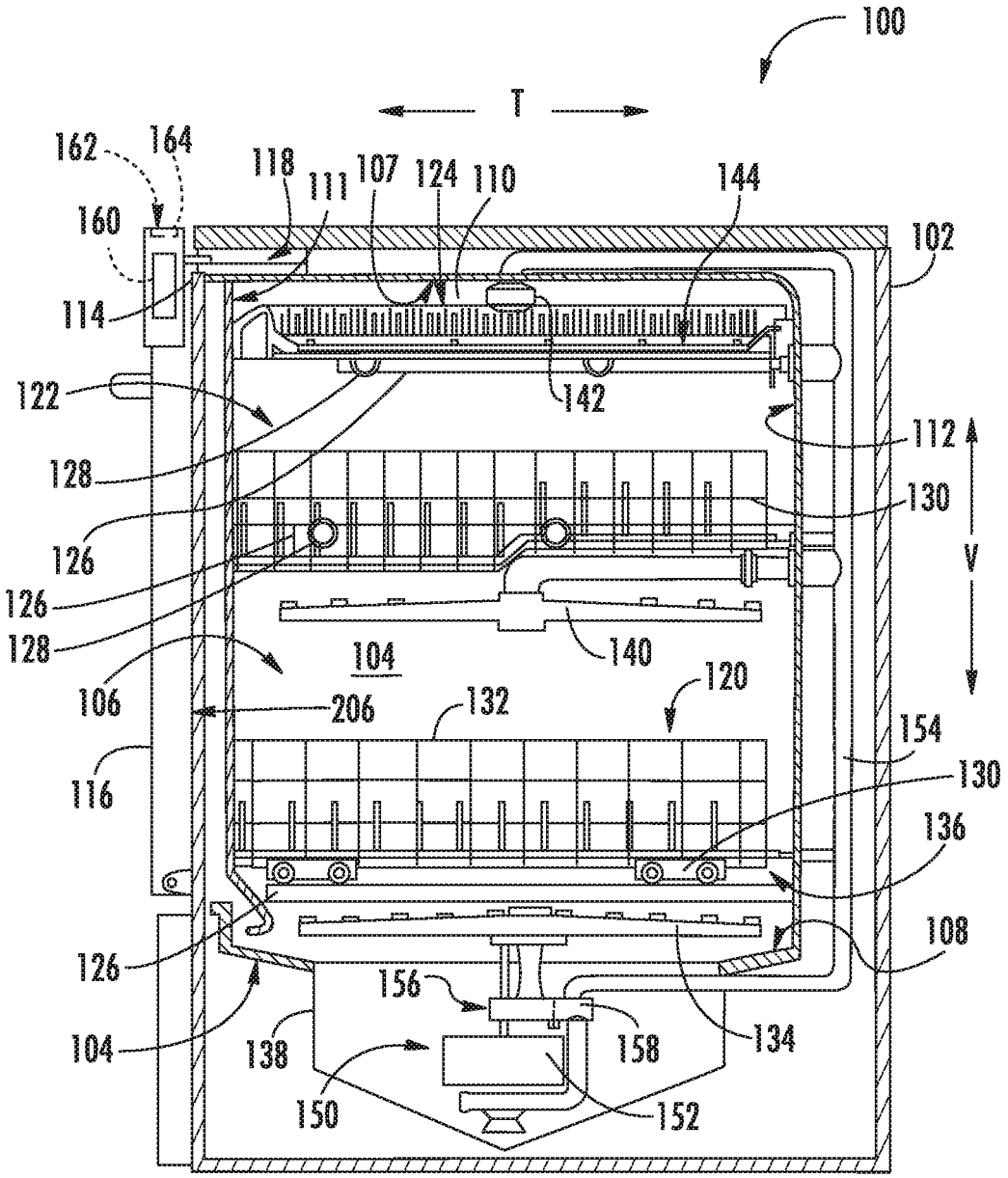
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, a lower rack assembly 120, a middle rack assembly 122, and an upper rack assembly 124 are stacked along the vertical direction V within wash chamber 106. Each rack assembly 120, 122, 124 is adapted for movement between an extended loading position (not shown) in which the rack is substantially positioned outside the wash chamber 106, and a retracted position (shown in FIGS. 1 and 2) in which the rack is located inside the wash chamber 106. With respect to middle rack assembly 122 and upper rack assembly 124, this is facilitated, for example, by guide rails 126 which are mounted to side walls 110 and rollers 128 mounted onto rack assemblies 122, 124, respectively. In addition, lower rack assembly 120 may include a plurality of carrier roller assemblies 130 which slidably support lower rack assembly 120, thereby permitting the lower rack to roll out of wash chamber 106 and rest on door 116 when it is in the open (i.e., horizontal) position.

Some or all of the rack assemblies 120, 122, 124 are fabricated into lattice structures including a plurality of wires or elongated members 132 (for clarity of illustration, not all elongated members making up rack assemblies 120, 122, 124 are shown in FIG. 2). In this regard, rack assemblies 120, 122, 124 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 120, for placement of silverware, utensils, and the like, that are otherwise too small to be accommodated by rack 120.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 120. Similarly, a mid-level spray arm assembly 140 is located in an upper region of wash chamber 106 and may be located below and in close proximity to middle rack assembly 122. In this regard, mid-level spray arm assembly 140 may generally be configured for urging a flow of wash fluid up through middle rack assembly 122 and upper rack assembly 124. Additionally, an upper spray assembly 142 may be located above upper rack assembly 124 along the vertical direction V. In this manner, upper spray assembly 142 may be configured for urging and/or cascading a flow of wash fluid downward over rack assemblies 120, 122, and 124. As further illustrated in FIG. 2, upper rack assembly 124 may further define an integral spray manifold 144, which is generally configured for urging a flow of wash fluid substantially upward along the vertical direction V through upper rack assembly 124.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 120, 122, 124, different spray arm assemblies 134, 140, 142 and spray manifold configurations may be used, and other differences may be applied while remaining within the scope of the present subject matter.

Referring now generally to FIGS. 3 through 8, a spray nozzle 200 will be described according to an exemplary embodiment of the present subject matter. Spray nozzle 200 may be used in dishwashing appliance 100 or in any other suitable dishwasher or cleaning appliance. For example, spray nozzle 200 may be incorporated into spray arm assemblies 134, 140, 142, or into integral spray manifold 144 to provide more even spray coverage. Indeed, although spray nozzle 200 is illustrated as a standalone assembly in FIGS. 3 through 6, it should be appreciated that spray nozzle could be incorporated into any suitable spray arm or device. The exemplary embodiments described herein are not intended to limit the scope of the present subject matter in any manner.

Figure 3:
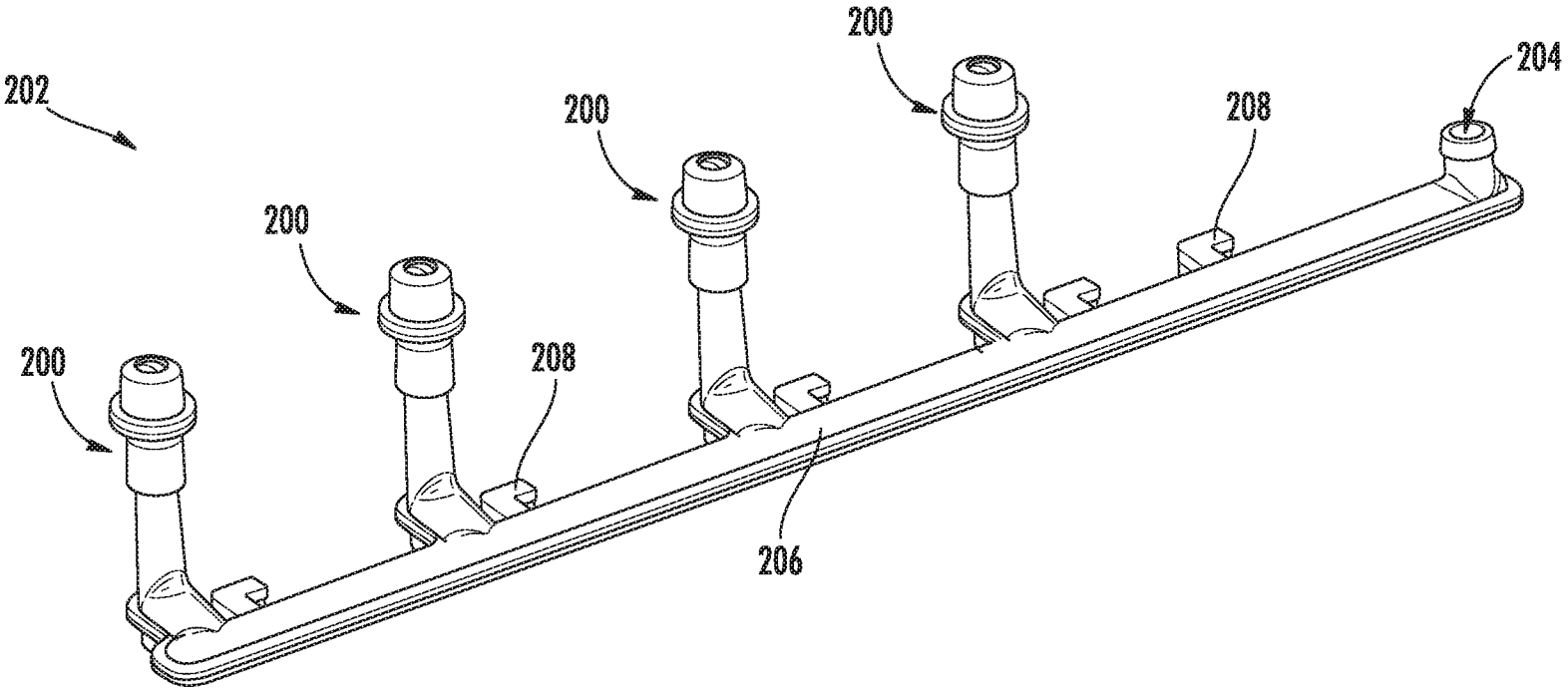
FIG. 3 provides a perspective view of a spray arm assembly that may be used in the exemplary dishwashing appliance of FIG. 1 according to an exemplary embodiment of the present subject matter.

Referring specifically to FIG. 3, a plurality of spray nozzles 200 may be spaced apart along a spray arm 202. Spray arm 202 may be a stationary, translating, or rotating arm positioned within wash chamber 106. Spray arm 202 defines an inlet 204 which may be coupled to a fluid supply, e.g., such as fluid circulation assembly 150 by primary supply conduit 154. In this manner, spray arm 202 may receive a flow of wash fluid through the inlet 204 which may be distributed to the plurality of spray nozzles 200 through a distribution conduit 206. According to the illustrated embodiment, spray arm 202 is configured for fixed mounting (e.g., via mounting clips 208) adjacent a silverware or bottle cleaning rack (not shown) within wash chamber 106. However, according to alternative embodiments, spray arm 202 may be positioned at any other suitable location and may include any other suitable number and configuration of spray nozzles 200. The exemplary embodiment illustrated herein is intended only for the purpose of describing aspects of the present subject matter, and is not intended to be limiting.

Figure 4:
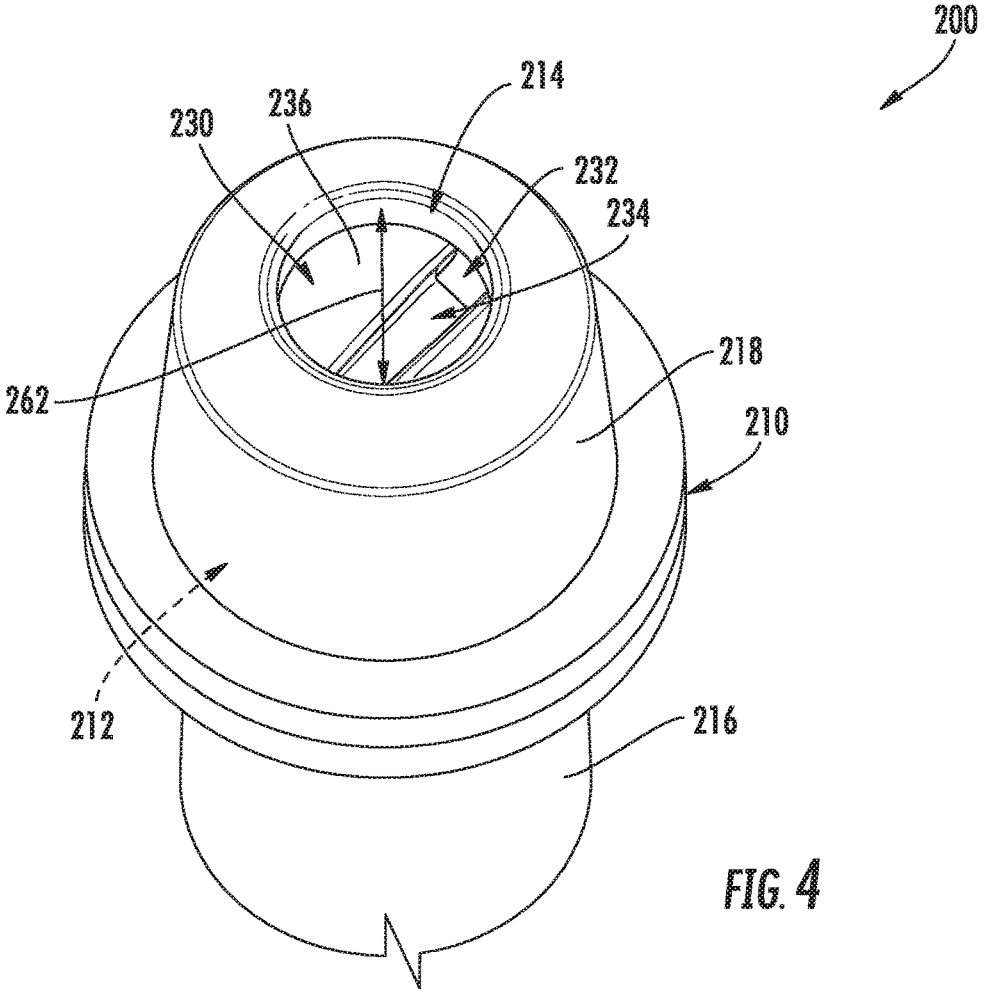
FIG. 4 provides a perspective view of a spray nozzle that may be used in the exemplary spray arm assembly of FIG. 3 according to an exemplary embodiment of the present subject matter.
Figure 5:
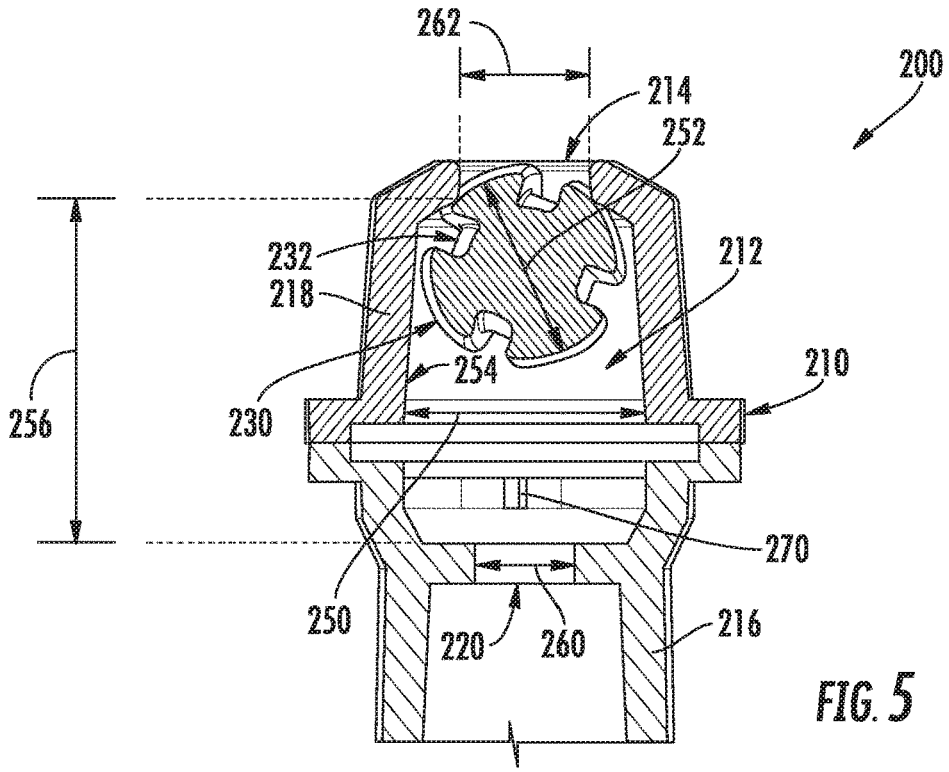
FIG. 5 provides a side cross-sectional view of the exemplary spray nozzle of FIG. 4 according to an example embodiment of the present subject matter.
Figure 6:
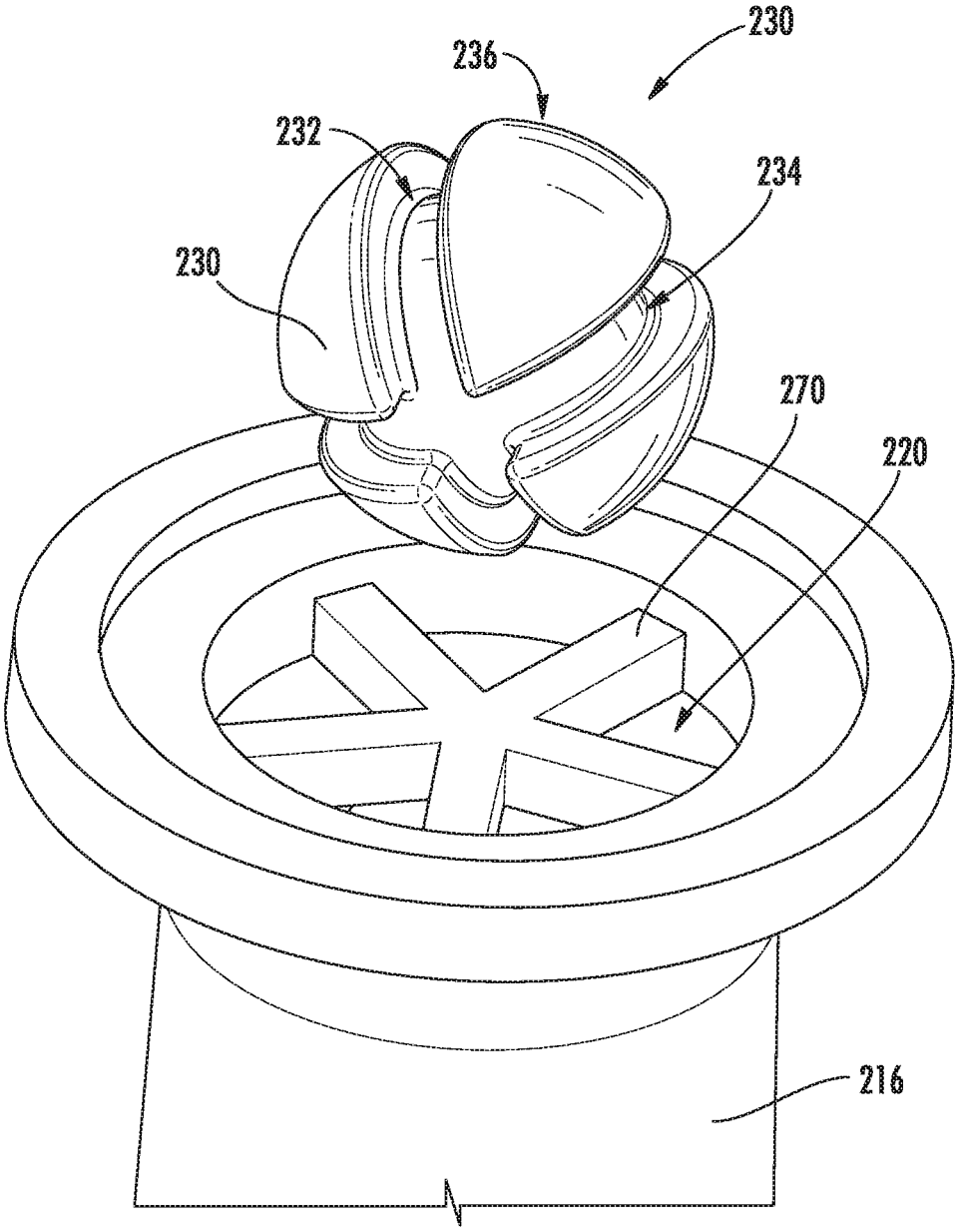
FIG. 6 provides a perspective view of the exemplary spray nozzle of FIG. 4 with an upper housing removed for clarity according to an exemplary embodiment of the present subject matter.

Referring now specifically to FIGS. 4 through 6, spray nozzle 200 will be described in more detail according to an exemplary embodiment of the present subject matter. As illustrated spray nozzle 200 includes a housing 210 that defines a spray chamber 212 which is in fluid communication with fluid circulation assembly 150. In addition, housing 210 defines a discharge orifice 214 through which wash fluid is directed onto articles within wash chamber 106. More specifically, according to the illustrated embodiment, housing 210 includes a lower housing 216 and an upper housing 218 which are joined together to define spray chamber 212 therebetween. Lower housing 216 further defines a chamber inlet 220 for receiving the flow of wash fluid.

Thus, the flow of wash fluid is received through the single chamber inlet 220 and flows through spray chamber 212 to the single discharge orifice 214 which is configured for discharging and directing the flow of wash fluid onto articles to be cleaned. Continuing the example described with respect to FIG. 3, fluid circulation assembly 150 may provide a flow of wash fluid which is directed through primary supply conduit 154, into spray arm inlet 204, along distribution conduit 206, and into spray chamber 212 via chamber inlet 220. Notably, in order to improve spray coverage, spray nozzle 200 may further include a diversion element 230 which is positioned within spray chamber 212 and is configured for randomly redirecting the flow of wash fluid out of spray nozzle 200.

Diversion element 230 generally defines a plurality of flow paths 232 and is movable between a lowered position (not shown) and a raised position (FIG. 5) within spray chamber 212. Specifically, diversion element 230 may be configured for falling toward the lowered position when the flow of wash fluid is off and may be urged towards the raised positioned under the force of the flow of wash fluid during a wash or rinse cycle. In this manner, fluid circulation assembly 150 may be selectively operated to move diversion element 230 between the lowered and raised position. Notably, every time diversion element 230 is moved from the lowered position to the raised position, it is randomly oriented and reseated against discharge orifice 214. In this manner, one or more of the plurality of flow paths 232 may direct the flow of wash fluid out a discharge orifice 214 in a different direction or orientation corresponding to the orientation of diversion element 230.

Figure 7:
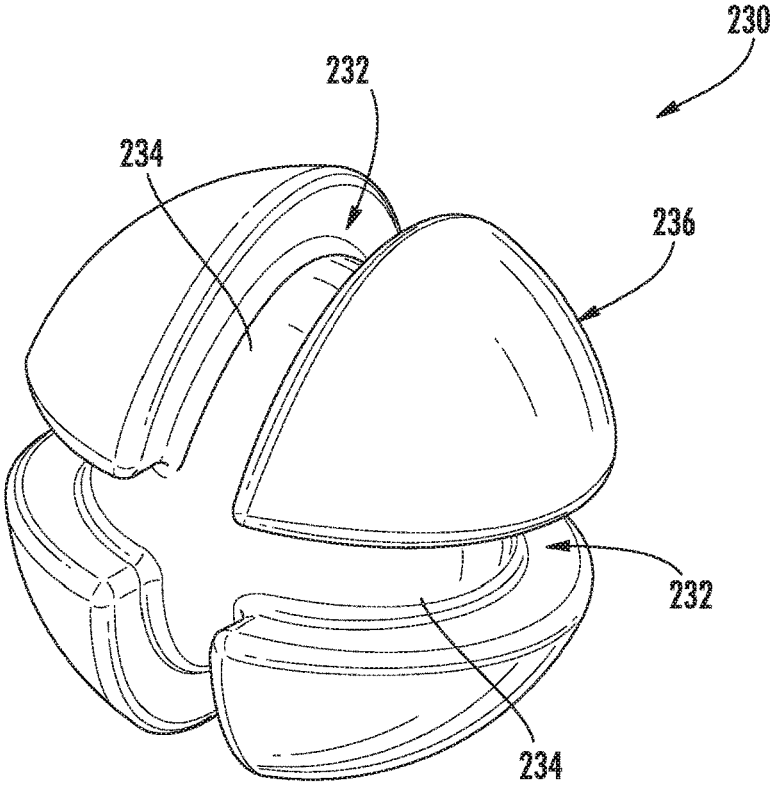
FIGS. 7 and 8 provide perspective views of exemplary diversion elements that may be used with the exemplary spray nozzle of FIG. 4.

Referring briefly to FIG. 7, an exemplary embodiment of diversion element 230 is illustrated. As shown, diversion element 230 is a substantially spherical component with various features (e.g., flow paths 232) defined therein. Specifically, as shown in FIG. 7, the plurality of flow paths 232 are elongated recesses 234 defined around a periphery 236 of diversion element 230. The depth and width of elongated recesses 234 may be designed to produce the desired spray patterns and achieve the desired impingement force.

Although only two circumferentially extending recesses 234 are illustrated herein, it should be appreciated that any suitable number, size, and direction of recesses 234 made be defined according to alternative embodiments. In this manner, as best shown in FIGS. 4 and 5, when diversion element 230 is urged towards the raised position, one or more of elongated recesses 234 provide a flow path from spray chamber 212 through discharge orifice 214. Notably, as explained above, every time diversion element 230 seats into discharge orifice 214, elongated recesses 234 direct the flow of wash fluid in a different spray pattern and direction for improved cleaning.

Figure 8:
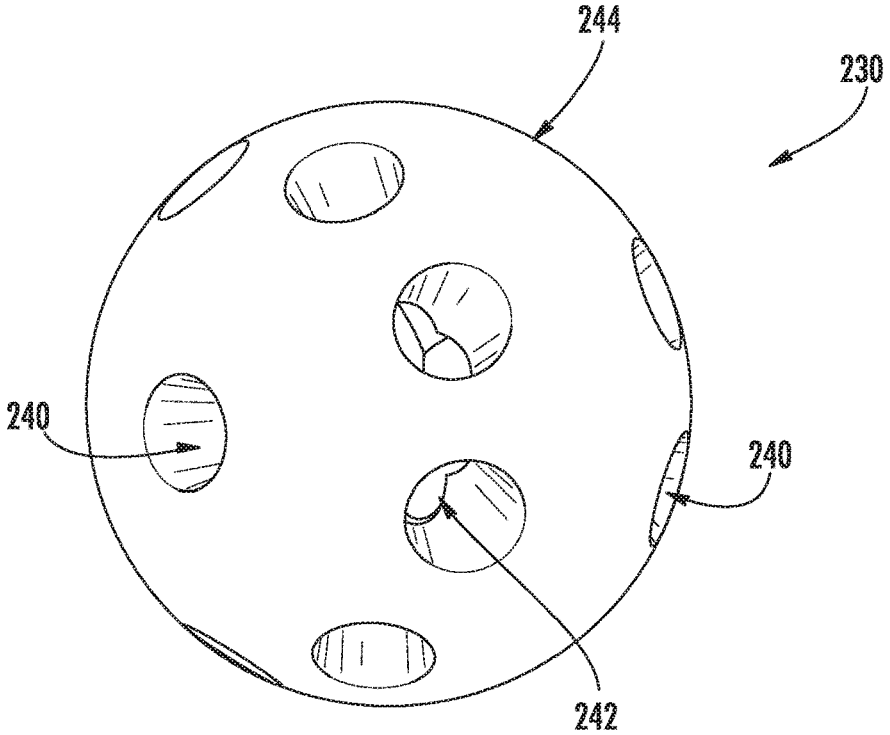

Referring briefly to FIG. 8, another exemplary embodiment of diversion element 230 is illustrated. Similar to the embodiment described above, diversion element 230 is a substantially spherical component. However, as shown in FIG. 8, the plurality of flow paths 232 are internal passageways 240 defined through an interior 242 of diversion element 230. According to an exemplary embodiment, diversion element 230 may have a thin outer wall 244 and may be substantially hollow, e.g., similar to a ping-pong ball. Alternatively, diversion element 230 may be substantially solid with internal passageways 240 meeting proximate a center of diversion element 230. According still other embodiments, internal passageways 240 may each be completely independent of other passageways and may be routed through diversion element 230 in any suitable path or direction.

It should be appreciated that any suitable number, size, and direction of internal passageways 240 may be defined according to alternative embodiments. In this manner, when diversion element 230 is urged towards the raised position, one or more of internal passageways 240 provide a flow path from spray chamber 212 through discharge orifice 214. Notably, as explained above, the direction and orientation of internal passageways 240 opening through discharge orifice 214 changes every time diversion element 230 is seated, thereby creating a unique and improved spray pattern.

Notably, in order to facilitate the movement of diversion element 230 within spray chamber 212, diversion element 230 must generally have smaller dimensions than spray chamber 212, e.g., to prevent binding as diversion element 230 moves between the lowered and raised position. Therefore, according to the exemplary illustrated embodiment, spray chamber 212 defines a chamber width 250 and diversion element 230 defines an element diameter 252. According to the illustrated embodiment, chamber width 250 is greater than element diameter 252. Moreover, as best illustrated in FIG. 5, spray chamber 212 has tapered side walls 254 such that chamber width 250 is greater toward the bottom of spray nozzle 200, e.g., toward chamber inlet 220.

In addition, according to the illustrated embodiment spray chamber 212 defines a chamber height 256. According to an exemplary embodiment, chamber height 256 is greater than element diameter 252 of diversion element 230. According to the illustrated embodiment, chamber height 256 is greater than or equal to two times element diameter 252, although other dimensional differences are possible and within the scope of the present subject matter. In this manner, diversion element 230 may move about freely within spray chamber 212. Notably, however, by tapering side walls 254, diversion element 230 may be consistently seated over discharge orifice 214 when moved toward the raised position.

Notably, it is important that diversion element 230 is retained within spray chamber 212 throughout operation of spray nozzle 200. Therefore, spray nozzle 200 may include various features for retaining diversion element 230 within spray chamber 212. For example, according to the illustrated embodiment, diversion element 230 is substantially spherical and has element diameter 252. Thus, according to an exemplary embodiment, chamber inlet 220 may define an inlet diameter 260 that is smaller than element diameter 252 such that diversion element 230 may not fall out of spray nozzle 200, e.g., back into distribution conduit 206. Similarly, discharge orifice 214 may define an orifice diameter 262 which is also smaller than element diameter 252.

According still another embodiment, spray nozzle 200 may include a retention element 270 that is positioned within spray chamber 212 below diversion element 230 for retaining diversion element 230 within spray chamber 212. In general, retention element 270 may be any feature or component that extends into spray chamber 212 and that permits the flow of wash fluid while restricting diversion element 230 from moving below retention element 270. For example, according to the illustrated embodiment, retention element 270 is a five-armed cross member positioned over chamber inlet 220. However, it should be appreciated that according to alternative embodiments, retention element 270 may be a single cross bar within spray chamber 212, a mesh screen, or any other suitable retaining feature.

Although chamber inlet 220 and discharge orifice 214 are illustrated and described herein as having a substantially circular cross section, it should be appreciated that according to alternative embodiments, chamber inlet 220 and discharge orifice 214 may have any other suitable size and shape. For example, discharge orifice 214 could instead be an elongated slot defined in upper housing 218. Similarly, although diversion element 230 is illustrated as being substantially spherical, it could have any other suitable shape, size, and flow paths 232 according to alternative embodiments. The exemplary embodiment of spray nozzle 200 described herein is not intended to limit the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a wash tub that defines a wash chamber;

a wash rack mounted within the wash chamber, the wash rack being configured for receiving articles for washing;

a fluid circulation assembly for providing a flow of wash fluid for cleaning articles placed within the wash chamber; and a spray nozzle comprising:

a housing defining a spray chamber in fluid communication with the fluid circulation assembly, the housing defining a discharge orifice; and a diversion element positioned within the spray chamber, the diversion element defining a plurality of flow paths and being movable between a lowered position and a raised position, at least one of the plurality of flow paths directing the flow of wash fluid through the discharge orifice when the diversion element is in the raised position, wherein the fluid circulation assembly is selectively operated to move the diversion element between the lowered and the raised position, such that the diversion element is randomly oriented each time the fluid circulation assembly urges the flow of wash fluid.

2. The dishwasher appliance of claim 1, wherein the housing comprises:

a lower housing defining a chamber inlet for receiving the flow of wash fluid; and an upper housing coupled to the lower housing to define the spray chamber between the lower housing and the upper housing.

3. The dishwasher appliance of claim 2, wherein the chamber inlet defines an inlet diameter and the diversion element defines an element diameter, the inlet diameter being smaller than the element diameter.

4. The dishwasher appliance of claim 1, wherein the spray nozzle comprises:

a retention element positioned within the spray chamber below the diversion element for retaining the diversion element in the spray chamber.

5. The dishwasher appliance of claim 1, wherein the plurality of flow paths are elongated recesses defined around a periphery of the diversion element.

6. The dishwasher appliance of claim 1, wherein the plurality of flow paths are internal passageways defined through an interior of the diversion element.

7. The dishwasher appliance of claim 1, wherein the diversion element is substantially spherical.

8. The dishwasher appliance of claim 1, wherein the spray chamber defines a chamber width and the diversion element defines an element diameter, the chamber width being greater than the element diameter.

9. The dishwasher appliance of claim 8, wherein the spray chamber defines a chamber height, the chamber height being greater than the element diameter of the diversion element.

10. The dishwasher appliance of claim 8, wherein the spray chamber has tapered sidewalls such that the chamber width is greater toward a chamber inlet.

11. The dishwasher appliance of claim 1, wherein the spray nozzle is one of a plurality of spray nozzles spaced apart and mounted on a spray arm.

12. A spray nozzle for a dishwasher appliance, the dishwasher appliance comprising a fluid circulation assembly for selectively urging a flow of wash fluid, the spray nozzle comprising:

a housing defining a spray chamber in fluid communication with the fluid circulation assembly, the housing defining a discharge orifice; and a diversion element positioned within the spray chamber, the diversion element being substantially spherical and defining a plurality of flow paths and being movable between a lowered position and a raised position, at least one of the plurality of flow paths directing the flow of wash fluid through the discharge orifice when the diversion element is in the raised position.

13. The spray nozzle of claim 12, wherein the spray nozzle comprises:

a retention element positioned within the spray chamber below the diversion element for retaining the diversion element in the spray chamber.

14. The spray nozzle of claim 12, wherein the plurality of flow paths are elongated recesses defined around a periphery of the diversion element.

15. The spray nozzle of claim 12, wherein the plurality of flow paths are internal passageways defined through an interior of the diversion element.

16. The spray nozzle of claim 12, wherein the spray chamber defines a chamber width and the diversion element defines an element diameter, the chamber width being greater than the element diameter.

17. The spray nozzle of claim 16, wherein the spray chamber defines a chamber height, the chamber height being greater than the element diameter of the diversion element.

18. The spray nozzle of claim 16, wherein the spray chamber has tapered sidewalls such that the chamber width is greater toward a chamber inlet.

19. A spray nozzle for a dishwasher appliance, the dishwasher appliance comprising a fluid circulation assembly for selectively urging a flow of wash fluid, the spray nozzle comprising:

a housing defining a spray chamber in fluid communication with the fluid circulation assembly, the housing defining a discharge orifice, wherein the spray chamber defines a chamber width; and a diversion element positioned within the spray chamber, the diversion element defining a plurality of flow paths and being movable between a lowered position and a raised position, at least one of the plurality of flow paths directing the flow of wash fluid through the discharge orifice when the diversion element is in the raised position, wherein the diversion element defines an element diameter, the chamber width being greater than the element diameter.

20. The spray nozzle of claim 19, wherein the plurality of flow paths are elongated recesses defined around a periphery of the diversion element.

* * * * *